United States Patent [19]

Elsas

[11] 3,955,515

[45] May 11, 1976

[54] FOLDING AND HEMMING METHOD AND APPARATUS

[75] Inventor: Norman E. Elsas, Atlanta, Ga.

[73] Assignee: Nemo Industries, Inc., Atlanta, Ga.

[22] Filed: Oct. 7, 1974

[21] Appl. No.: 512,468

[52] U.S. Cl. ..... 112/121.15; 112/262

[51] Int. Cl.[2] ..... D05B 21/00

[58] Field of Search ..... 112/121.11, 121.12, 112/121.15, 203, 262, 147, 10, 2, 141, 121.29

[56] References Cited

UNITED STATES PATENTS

| | | | |
|---|---|---|---|
| 3,722,435 | 3/1973 | Elsas | 112/121.11 |
| 3,773,002 | 11/1973 | Burton | 112/262 |
| 3,871,309 | 3/1975 | Frost | 112/121.29 |
| 3,884,166 | 5/1975 | Rinehimer | 112/121.29 |

*Primary Examiner*—Werner H. Schroeder
*Assistant Examiner*—Peter Nerbun
*Attorney, Agent, or Firm*—Jones, Thomas & Askew

[57] ABSTRACT

The side edges of a web of cloth are hemmed as the web moves from a supply along its length to a cutting station. The free end portion of the web of cloth is cut across its length with V-shaped notches cut at its side edges to form angled corners on the cut lengths of cloth. The cut lengths of cloth are moved through a U-shaped path with the cut ends extending along the path, and a connecting thread is attached to the cut lengths of cloth adjacent their cut ends and extends between adjacent lengths of cloth so as to connect together the cut lengths of cloth as they move sequentially through folding and sewing apparatus. The connecting thread extending between the adjacent cut lengths of cloth allows a preceding length to pull and guide a subsequent length through a hem folding device.

18 Claims, 8 Drawing Figures

FOLDING AND HEMMING METHOD AND APPARATUS

BACKGROUND OF THE INVENTION

In the manufacture of hemmed lengths of cloth, such as napkins or other hemmed items, the cloth lengths have been manufactured by cutting lengths of cloth from a generally continuous supply or web of cloth, and manually folding over and sewing through the edge portions of the lengths of cloth to form a neat hem about the length of cloth. In some instances, the corners of the cut lengths of cloth are cut with an angled cut so as to reduce the amount of material in the folded hems that would be formed at the corners of the finished product.

The typical prior art process of forming napkins and other items requires that the cut lengths of cloth be manually handled by sewing machine operators, with the sewing machine operators folding and guiding the edges of the cloth lengths through a sewing machine to form the hems at the edges of the product. While some automated machinery has been developed to relieve the machine operators from continuous and close observation and control of the machines used for hemming cloth lengths, as shown by my prior U.S. Pat. No. 3,722,435, it is still difficult to properly form folded hems on two or three sides or on all four sides of a cloth product with automated machinery. While the process of folding and sewing through the folds to form a hem in the side edges of a continuous length of cloth is relatively simple to perform in an automated process, once the cloth lengths are cut apart to form shorter cut lengths of cloth, the automated procedure becomes much more difficult since it requires individual handling of each cut length of cloth, and the hems formed at the cut ends of the cut lengths of cloth extend over the hems of the adjacent side edges, which adds additional thickness to the product and makes the product even more difficult to handle.

SUMMARY OF THE INVENTION

Briefly described, the present invention comprises a method and apparatus for forming hemmed products such as table napkins from a web or generally continuous supply of cloth or other material in a continuous mechanical process which does not require the manual handling of the cut lengths of cloth. The web is fed from a supply along its length to a cutting station and the side edges of the continuous web are folded and sewn to form side hems as the web moves toward the cutting station. The free end of the web is cut across the length of the web at the cutting station and the cut lengths of cloth are then moved in a U-shaped path generally normal to the direction from which the continuous supply of cloth was fed to orient the cut ends in an attitude parallel to the direction of movement of the cut lengths along the U-shaped path. As the cut lengths of cloth are conveyed through the U-shaped path, a connecting thread is connected to the cut lengths of cloth adjacent their cut ends, and the connecting thread extends between adjacent ones of the cut lengths of cloth to connect the cut lengths of cloth together in a connected series. The cut ends are then moved through folding devices which fold the cut ends onto the body of the cut lengths of cloth, and sewing machines sew through the folds. The connecting threads tend to guide and pull the leading portions of the cut ends of the lengths of cloth through the folding devices.

Thus, it is an object of the present invention to provide an improved method and apparatus for forming folded hems in cut lengths of material from a generally continuous source of material in a continuous, automatic, mechanical process.

Another object of this invention is to provide an inexpensive, durable and versatile apparatus for rapidly and accurately cutting and folding and sewing hems in the edges of lengths of material.

Another object of the invention is to provide an improved procedure for forming folded hems in lengths of material.

Other objects, features and advantages of the present invention will become apparent upon reading the following specification, when taken in conjunction with the accompanying drawing.

DESCRIPTION OF AN EMBODIMENT

Figures 1, 3:
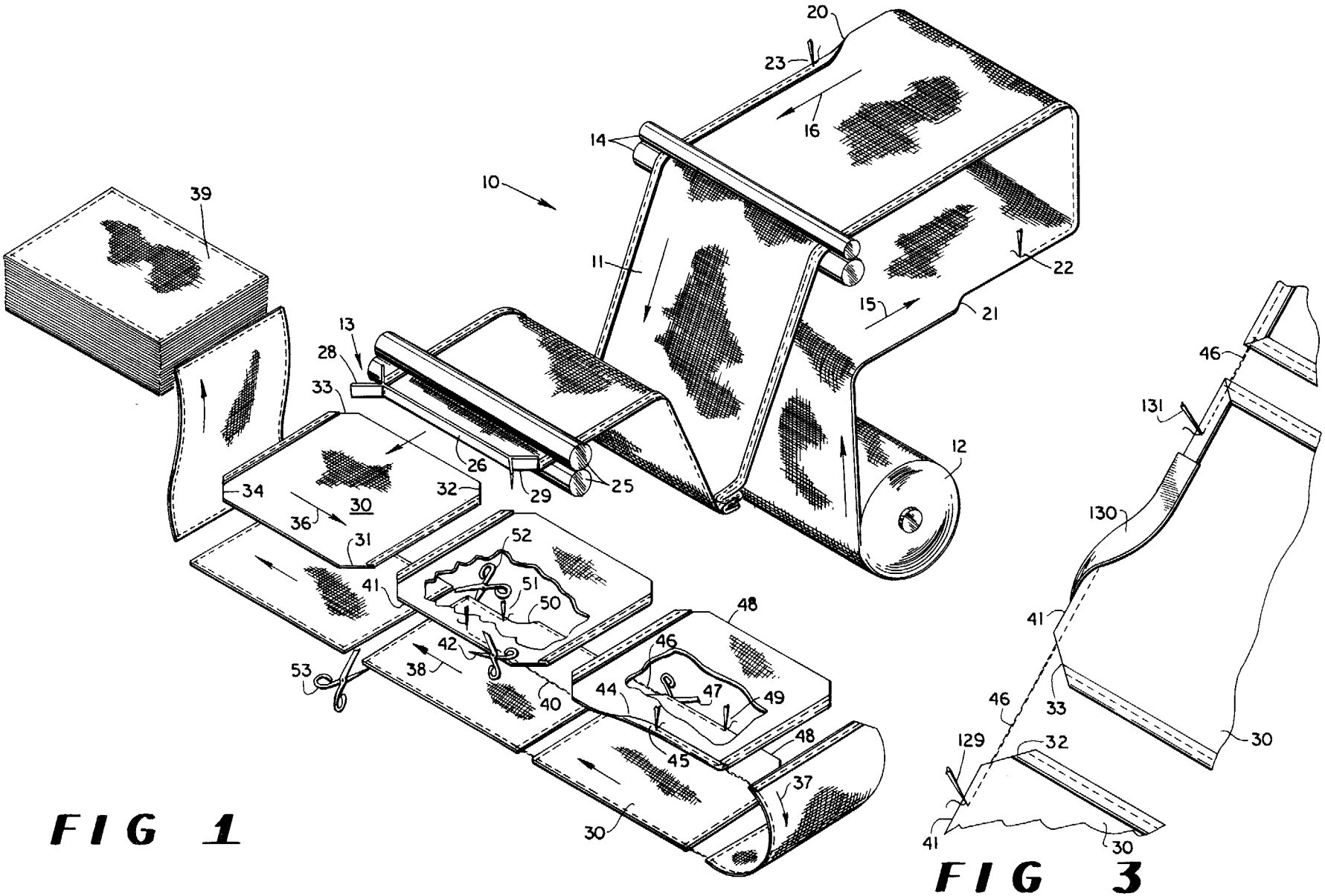
FIG. 1 is a schematic illustration of the cutting and hemming process of the present invention.
FIG. 3 is a detail illustration of a portion of the process, showing the method of chain-stitch connecting the cloth lengths together, folding, and sewing through the folds.

Referring now in more detail to the drawing, in which like numerals indicate like parts throughout the several views, FIG. 1 discloses the process 10 for forming hemmed cloth lengths wherein a web or continuous length of woven cloth or other sheet material 11 is moved from a supply 12 along a path toward a cutting station 13. The web of cloth is pulled from the supply by one or more pairs of feed rollers 14 through first and second horizontal paths as indicated by arrows 15 and 16. The side edges of the web are folded onto the surface of the web as indicated at 20 and 21, and the folds are sewn closed as indicated at 22 and 23. Feed rollers 25 move the web of cloth into cutting station 13. A steel rule die knife 26 is located at cutting station 13, and the knife optionally includes V-shaped end portions 28 and 29 at one or both of its ends for cutting notches of cloth from the web as the web is cut. If the knife includes the V-shaped end portions as illustrated, the result is that the normally right-angle corners of the cut lengths of cloth 30 are mitred or angled, as indicated at 31, 32, 33 and 34.

The cut lengths of cloth 30 are then moved through a U-shaped path 35, first as indicated by arrow 36 along the upper horizontal leg of the U-shaped path, then in a downward arcuate direction as indicated by arrow 37, and then along the lower horizontal leg of the U-shaped path as indicated by arrow 38. At the end of the lower horizontal leg, the cut lengths of cloth are stacked as indicated by the stack 39. A connecting thread, illustrated in FIGS. 1–3 as a continuous chain link stitch 40, is formed in the cut lengths of cloth as the cloth moves along the upper horizontal leg of the U-shaped path 35, and the stitching extends between adjacent ones of the cut lengths of cloth and forms a connected series of cloth lengths. If necessary, the cut end 41 can be trimmed as indicated by cutter 42. As the cut end 41 continues along the upper horizontal leg of the U-shaped path, the cut end 41 is folded onto the body of the cut length of cloth, as indicated at 44, and the fold is sewn closed, as indicated at 45. The stitch formed through the fold can be a chain link stitch or other stitch, as may be desired. The chain link stitching 40 which is formed in the cloth lengths before the fold is formed can be located immediately adjacent the cut end 41 or it can be located further away from the cut end, as may be desired. In some situations, it may be desirable to have the chain link stitching 40 substantially hidden inside the fold, and if so, the stitching can be formed closely adjacent the cut end 41.

As the cut lengths of cloth 30 move along the lower horizontal leg of the U-shaped path 35, a second connecting thread, illustrated as continuous chain link stitch 46, is formed at the opposite cut ends 48 as indicated at 49, and the cut ends 48 can be trimmed as indicated by cutter 47. Again, the chain stitching 46 extends between adjacent ones of the cut lengths of cloth 30 and forms a connected series of cloth lengths.

The cut ends 48 of the lengths of cloth are folded over as indicated at 50 and the fold is sewn closed as indicated at 51. Thread chain cutting apparatus 52 and 53 then cut the stitching extending between adjacent lengths of cloth at both ends of the lengths of cloth, to completely separate the lengths of cloth from one another, and the cloth lengths are stacked at 39.

In most situations, it will be desirable to have the hems folded over onto the same surface of the cloth lengths. To accomplish this, the fold made at 20 at the side edge of the web as it moves through the horizontal portion 15 of the path is formed in a downward direction, while the fold made at 21 in the horizontal portion 16 of the path of the web is a fold made in an upward direction onto the web. In a similar manner, the fold made at 44 in the upper horizontal leg of the U-shaped path 35 is folded up, while the fold 50 in the lower horizontal leg 38 of the U-shaped path 35 is folded down.

The angled cuts 31, 32, 33 and 34 formed in the cut lengths of cloth by the knife having U-shaped end portions at both of its ends allow the folds at the cut ends of the lengths of cloth to be folded over without rolling up the previously formed hems in the side edges. If a web of cloth having a selvage on one or both side edges is processed through the system, one or both side edges will not be hemmed by the system and a knife having one or both of its end portions formed without the V-shape will be used.

Figures 2A, 7:
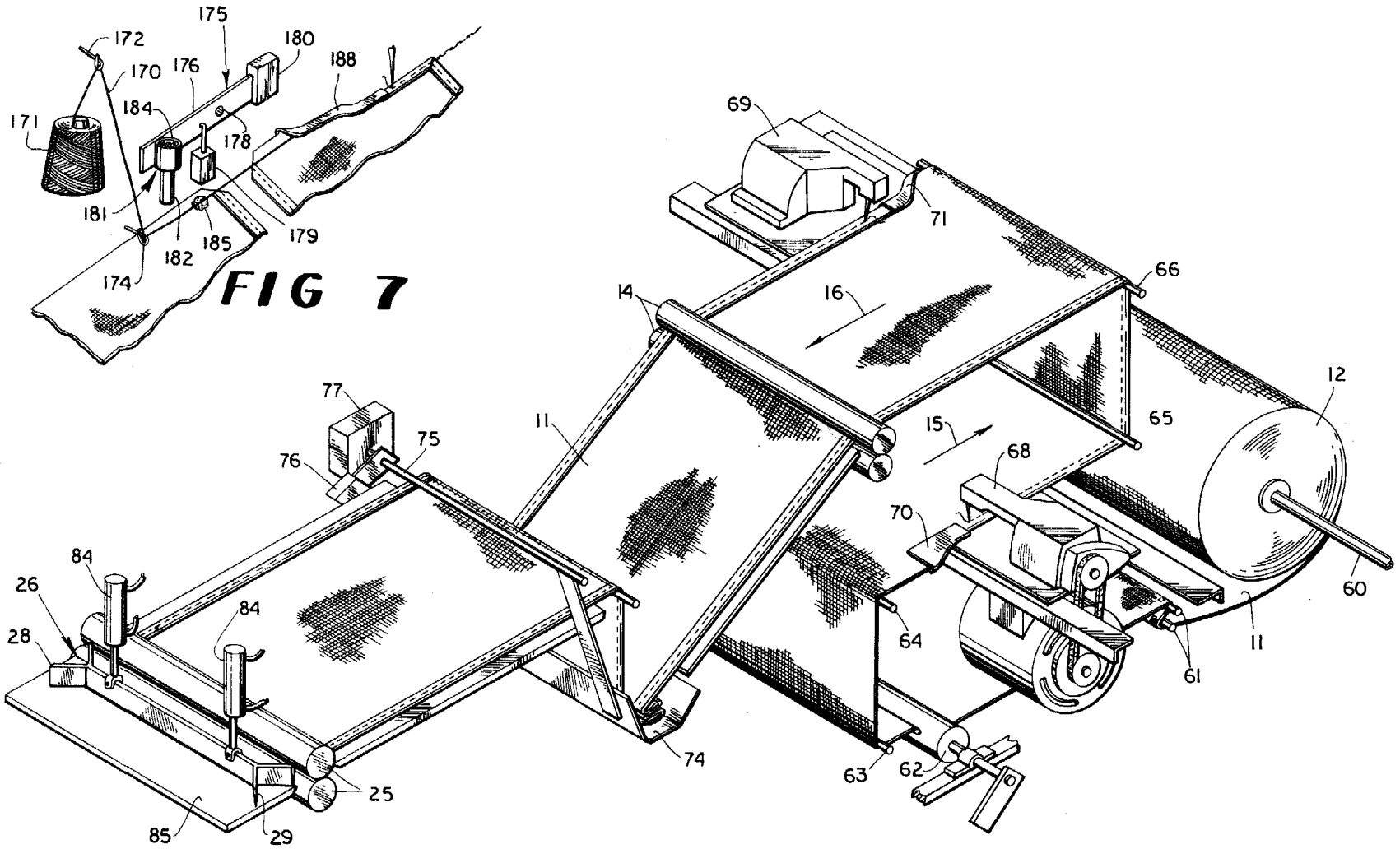
FIGS. 2A and 2B are schematic illustrations of the apparatus utilized to perform the process.
FIG. 7 is a detail illustration of a portion of the process, similar to FIGS. 3, 5 and 6, but showing a third embodiment of the invention.

As is illustrated in FIG. 2A, the apparatus for feeding the web toward the cutting station includes a support bar 60 for supporting the reel of cloth, and several guides 61, 62 63, 64, 65 and 66 which function both to guide and stretch the wrinkles from the web of cloth as the web moves toward the cutting station under the influence of feed rollers 14. Sewing machines 68 and 69 are mounted on opposite sides of the path traveled by the web, with sewing machine 68 being mounted at the horizontal leg 15 of the path and sewing machine 69 being mounted at the horizontal leg 16 of the path. Fold guides 70 and 71 tend to fold the side edges of the web inwardly with respect to the web so as to continuously form folds in the web. Fold guide 70 functions to fold the side of the cloth downwardly, while fold guide 71 functions to fold its side edge upwardly, so that both folds are formed on the same surface of the web.

J-pan 74 receives the web of cloth from feed rollers 14. J-pan 74 is pivotally mounted on support rod 75, and counterweight 76 tends to hold the J-pan at an incline. When a substantial amount of the web 11 is fed to the J-pan, the J-pan will tilt in a downward direction opposite to the influence of its counterweight. Switch 77 detects the attitude of J-pan 74 and controls the operation of feed rollers 14. When a sufficient amount of the web has accumulated in J-pan 74, the operation of feed rollers 14 will be terminated by switch 77.

Figure 2B:
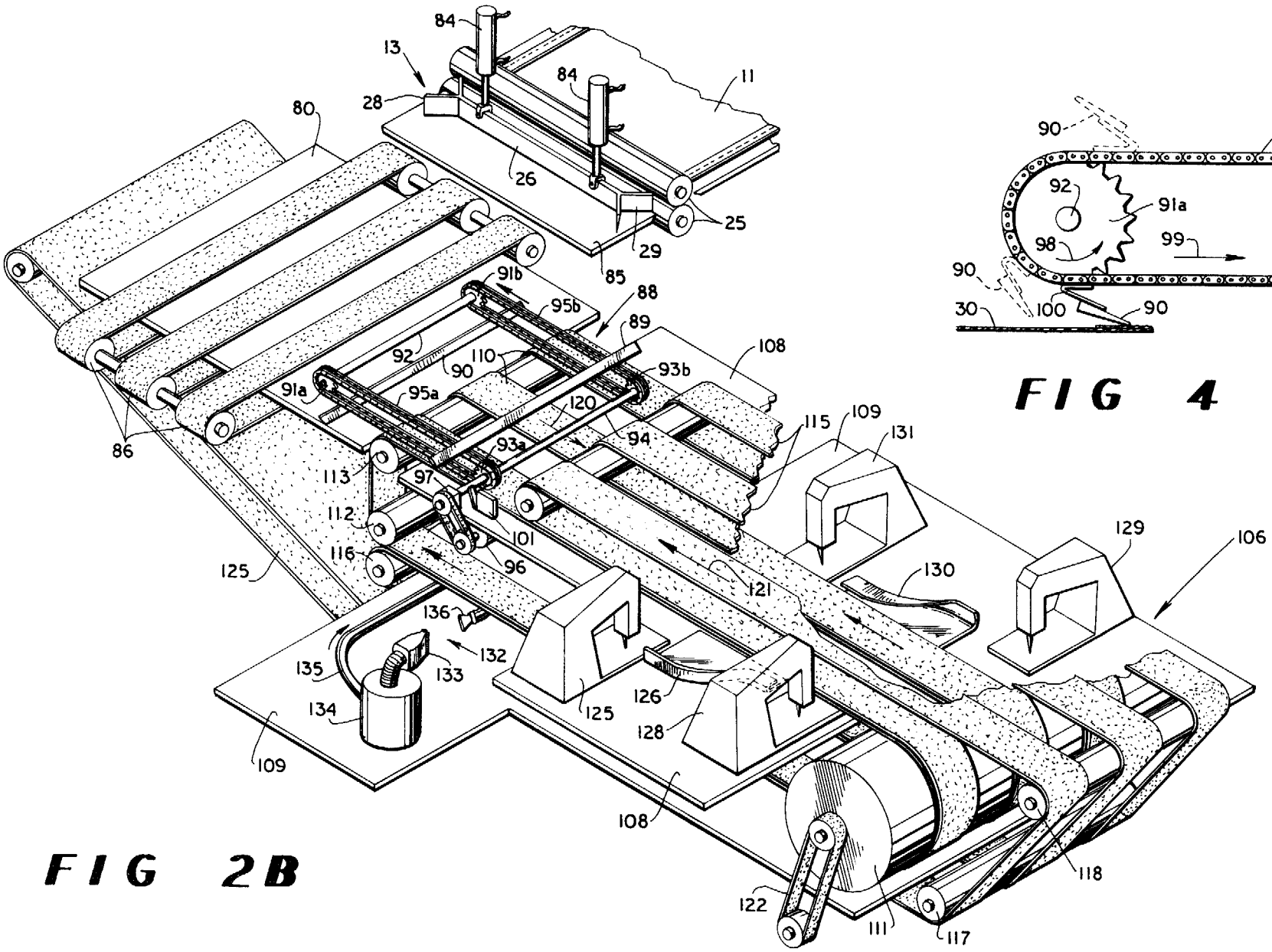

Cutting station feed rollers 25 pull the web from J-pan 74 and urge the web out on the cutting table 80 (FIG. 2B). The cutter 26 illustrated in the drawing comprises a steel rule die knife having V-shaped ends 28 and 29. The knife is actuated by rams 84 and the knife moves against hardened surface 85. The V-shaped ends 82 and 83 of the knife 81 function to form angled cuts across the otherwise right angle corners of the cut lengths of cloth. A photoelectric cell (not shown) is positioned vertically with respect to the transfer table 80 so as to detect the movement of the leading end of the web of cloth as the web of cloth moves onto the transfer table. When detection is made by the photoelectric cell, the operation of cutting station feed rollers 25 is interrupted and the rams 84 are actuated to cause the cutting blade to reciprocate downwardly against the cutting surface 85 to cut the web. Conveyor tapes 86 move at a higher velocity than cutting station feed rollers 25 but operate in on-off timed relationship with cutting station feed rollers 25 to move the free end of the web onto the transfer table 80.

Transfer table conveyor 88 is positioned over transfer table 80 and includes a pair of chain driven conveyor bars 89 and 90. Sprockets **91*a* and 91*b* are mounted on the ends of shaft 92, while sprockets 93*a* and 93*b* are mounted on the ends of shaft 94. Continuous roller chains 95*a* and 95*b* extend around the sprockets in the manner illustrated in the drawing, and shaft 94 is rotated by clutch brake motor 96 through gear reducer 97**.

Figure 4:
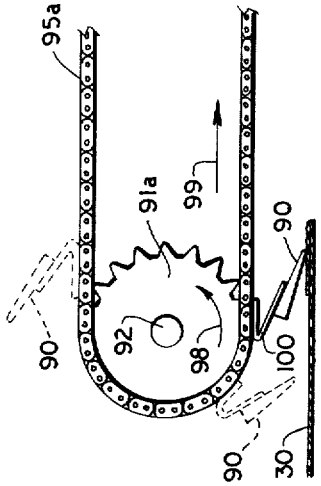
FIG. 4 is a detail illustration of the transfer table conveyor.

As indicated in FIG. 4, the sprocket 91a is rotated in the direction indicated by arrow 98, and the continuous chains **95*a* and 95*b* move as indicated by arrow 99. Conveyor bar 90 moves with the continuous chains 95*a* and 95*b* as indicated by the dashed line and full line representations of bar. The bar is connected to the chain by a leaf spring 100, and the bar is angled in a forward direction. As the bar moves around the sprockets 91*a* and 91*b* toward its lower travel position, the bar engages a cut length of cloth 30, and its leaf spring allows the bar to flex inwardly or upwardly toward the continuous chains 95*a* and 95*b*. Since the bar has a downward component of velocity as it first makes contact with a cut length of cloth 30, its initial contact with the cut length of cloth is firm and positive, so as to forceably grasp the cut length of cloth and cause it to accelerate from a standstill position to a direction of movement with the conveyor bar. To insure the positive grasp of the cloth, the conveyor bar can be fabricated from or coated with a high friction material. As the conveyor bar continues in its direction of travel about the sprockets 91***a* and 91*b* toward a horizontal direction of movement, the leaf springs 100 at each end of the conveyor bar will flex more easily and relieve some of the force applied by the conveyor bar to the cut length of cloth, but the leaf springs will maintain a predetermined amount of force in a downward direction on the cut length of cloth to cause the cut length of cloth to continue in its movement with the conveyor bar. When the conveyor bar and cut length of cloth reach the end of the horizontal travel of the conveyor bar, the conveyor bar swings in an arcuate upward direction away from the cut length of cloth and begins to move toward its upper horizontal return flight. Since the lower horizontal conveying flight of the conveyor bar extends beyond the transfer table and over the inner conveyor belt of the U-shaped conveyor system (described more fully hereinafter), the cut lengths of cloth will be moved into the U-shaped conveyor system before the conveyor bar 90 breaks contact with the cut lengths of cloth.

Clutch brake motor 96 is actuated by the same photoelectric cell (not shown) used to actuate knife 26 and feed rollers 25. Switch 101 is positioned in the path of the conveyor bars 89 and 90, and when one of the conveyor bars engages the switch 101, the clutch brake motor 96 functions to terminate the movement of the transfer table conveyor.

Conveyor system 96 includes a series of conveyor tapes arranged in a U-shaped path so as to move the cut lengths in the U-shaped path indicated at 35 in FIG. 1. The conveyor system includes upper conveyor table 108 and lower conveyor table 109. An inner set of conveyor tapes 110 moves about conveyor drum 111 and about guide rollers 112 and 113. An outer set of conveyor tapes 115 moves about drum 111 and guides 116, 117, 118 and 119. The inner set of conveyor tapes moved in the direction as indicated by arrow 120, and the outer set of conveyor tapes moves in the direction as indicated by arrow 121. The arrangement is such that the inner conveyor tapes 110 move in an upward direction about guides 113 and then in a lateral direction away from transfer table 80 so that they receive the cut lengths of cloth from the transfer table 80 and the transfer conveyor 88. The outer conveyor tapes 115 move around the guide 119 down into a sandwich relationship with respect to the cut lengths of cloth and the inner conveyor tapes 110, and all of the conveyor tapes and the cut lengths of cloth move in unison along the upper horizontal leg of the U-shaped path toward conveyor drum 111. When the cut lengths of cloth and the upper flight of the conveyor tapes reach drum 111, the conveyor tapes and cut lengths of cloth move in unison around the drum 111 and into the lower horizontal leg of the U-shaped path of the conveyor system. As the cut lengths of cloth and conveyor tapes move through the upper leg of the U-shaped path, these elements are moving across the upper surface of upper conveyor table 108, and as these elements move along the lower horizontal leg of the U-shaped path of the conveyor system, these elements are moving across the upper surface of lower conveyor table 109. When the conveyor tapes and the cut lengths of cloth reach the end of the lower horizontal leg of the U-shaped path of the conveyor system, the conveyor tapes open apart, with the inner conveyor tapes passing around guides 112 in an upward direction back toward guides 113. The outer conveyor tapes move in a downward direction about guide 116, then in a reverse direction back behind conveyor drum 110 to guide 117, where they turn in an upward direction and move upwardly toward guide 118, and then back in a reverse horizontal direction toward guide 119. The system is driven by a motor (not shown) that drives conveyor drum 111 by means of drive system 122.

First sewing machine 125 is mounted in upper conveyor table 108 adjacent one side portion of the upper horizontal leg of the U-shaped path traveled by the cut lengths of cloth. Sewing machine 125 functions to continuously sew a chain link stitch into the cut lengths of cloth adjacent the cut ends. The chain link stitching also continues to be formed in the gaps between the cut lengths of cloth, so that the cut lengths of cloth are connected together by the chain link stitching, as illustrated more clearly in FIG. 1. Folder 126 is located adjacent the U-shaped path ahead of second sewing machine 128. Folder 126 functions to form an upward fold in the cut end of each cut length of cloth moving along the upper horizontal leg of the U-shaped path immediately prior to the position where second sewing machine 128 forms its stitching through the fold.

Third sewing machine 129 is positioned in lower conveyor table 99 and functions like first sewing machine 125, in that it continuously forms a chain link stitching in the opposite cut ends of the cut lengths of cloth as they move along the lower horizontal leg of the U-shaped path. Folder 130 forms a fold in the cut end of each length of cloth, with the fold being formed in a downward direction, and fourth sewing machine 131 sews through the fold.

After the hemmed lengths of cloth have been processed through the fourth sewing machine 131, there will be four strings of chain link stitching extending adjacent ones of the lengths of cloth as they continue to move along the lower horizontal leg of the U-shaped path. Chain cutter assemblies 132 are located beside the path of the chain link stitching at each side of the lengths of cloth (only one shown).

Chain cutter assemblies 132 each comprise a vibrating blade cutter 133 oriented in a non-parallel relationship to the plane of the cloth, a vacuum system 134, an exhaust conduit 135, and a nozzle 136. The blades of the cutter are illustrated as being oriented in a vertical plane and extending across the path of travel of the cut lengths of cloth; however, the blades can be angled up or downstream of the movement of the lengths of cloth or angled other than perpendicularly with respect to the plane of the cloth, if desired. The vacuum system 134 is arranged to create a field of low pressure in the vicinity of the cutting blades of the cutter 133, to induce the chain of thread to enter the blades of the cutter, and the exhaust conduit 135 and a nozzle 136 communicate with the exhaust of the vacuum system 134 so as to receive the filtered pressurized exhaust air, and nozzle 136 is positioned over working table 108 and directed toward the cutter 133 so as to form a stream of air approximately parallel to the plane of the cloth and extending toward the cutter, to urge the thread chains beyond the sides of the path of the cloth, into the field of vacuum of the cutter and into the cutter. The cutter then functions to cut the thread chains away from the adjacent lengths of cloth, so as to disconnect the cloth lengths from one another. If desired, an additional cutter (not shown) actuated by a photoelectric cell reading between the adjacent lengths of cloth can be utilized to initially cut the thread chains extending between the adjacent lengths of cloth, and cutter 133 can be positioned in the line behind the initial cutter to trim away the cut chains. The now-completed hemmed lengths of cloth are then allowed to fall from the conveyor tape at the end of the lower horizontal leg of the U-shaped path of the system, where they are received upon an inclined conveyor belt 125 and taken to a remote stacking area.

As is illustrated in FIG. 3, the continuous chain link stitching 40 is formed through the cut lengths of cloth 30 adjacent the cut ends 41 and across the angled cuts 31–34 across the corners of the lengths of cloth. While the position of the stitching is shown as being placed closely adjacent the cut ends 41, it will be understood that the stitching can be moved further over onto the center portion of the cut lengths of cloth away from the angled cuts across the corners if desired; however, it is anticipated that in most instances the visual presence of the chain link stitching 40 in the finished product would not be desirable and it therefore will be desirable to fold the chain link stitching into the hem of the product.

FIG. 3 illustrates how the chain link stitching 46 tends to pull each successive length of cloth into the folding device 130, and how the drag normally encountered in the typical folding device, particularly in the leading portions of the lengths of material, will be at least partially overcome by the pulling effect from the previously processed lengths of material. More specifically, the feed dogs of the sewing maching 131 at the exit side of the folding device 130 function as feed means and tend to pull the cut end of each length of cloth which is being sewn through the folder 130. As the trailing portion of one length of cloth is being sewn by sewing machine 131, the leading end of the subsequent length of cloth will be moving through folding device 130. While the folding device 130 would normally retard the movement of the edge portion of the length of cloth moving therethrough, the chain link stitching 46 extending to the prior length of cloth at the sewing machine 131 tends to pull the leading edge portion of the following length of cloth on through the folding device 130. This causes the leading portion of the following length of cloth to move properly through the folder during the time before it reaches the sewing machine 131, even though the feed dogs of the sewing machine 131 are not acting directly on the length of cloth extending through the folder. If desired, additional feed rollers can be added to the U-shaped path behind each folding device to function as additional feed means for moving the cut ends of cloth through the folding device.

Figure 5:
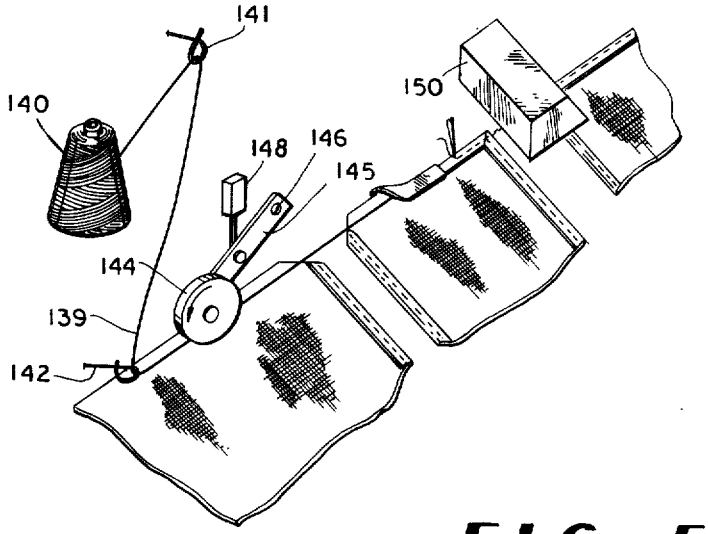
FIG. 5 is a detail illustration of a portion of the process, similar to FIG. 3, but showing a second embodiment of the invention.

While FIGS. 1–3 illustrate the connecting threads extending between adjacent lenghts of cloth as being chain link stitching, other types of connecting threads can be utilized. For example, FIG. 5 illustrates a system where a nylon thread 139 is taken from supply 140, passed through thread guides 141 and 142 to a position in contact with the cut end portions of the cut lengths of cloth. The nylon thread melts in response to the application of heat. For example, nylon threads are available which tend to melt at temperatures ranging between 300° and 500°F. One such nylon thread is Tri-E-X Set Polyester Thread available from Elmore Corporation of Spindale, N.C. Heated roll 144 is rotatably mounted on one end of support arm 145, and the heated roll 144 is urged in a downward direction by gravity about the fulcrum 146 of the support arm 145. Solenoid 148 is connected to support arm 145 and is arranged to lift support arm and heated roll 144 in an upward direction. Heated roll 144 is hollow and is heated by a conventional induction coil (not shown). A photoelectric cell (not shown) is located vertically with respect to the path of travel of the cut lengths of cloth adjacent heated roll 144 and detects the gaps between the cut lengths of cloth. Solenoid 148 responds to the signal from the photoelectric cell and tends to lift the heated roll 144 upwardly away from the moving cut lengths of cloth as a gap between the cut lengths of cloth passes beneath the heated roll. After the gap between the cut lengths of cloth has moved from beneath the heated roll 144, the photoelectric cell allows the solenoid 148 to drop the heated roll 144 back into contact with the cut end portion of the cut length of cloth passing therebeneath. The fusable thread 138 moves from guide 142 beneath heated roll 144, and as the thread passes beneath the heated roll, the heat from the roll fuses the thread into the cut lengths of cloth, so that the thread is attached to the cut lengths of cloth. As each cut length of cloth is about to completely pass under the heated roll, the photoelectric cell causes the solenoid 148 to lift the heated roll away from the cut length of cloth and the thread 139, so that the thread, which is being pulled from its fused portion in the cut length of cloth, is pulled by the cloth and tends to continue to pay out as the cut length of cloth continues to move, and when the subsequent cut length of cloth passes beneath the heated roll, the heated roll will again be allowed to move under the influence of gravity back into contact with the thread 139 in the following cut length of cloth and resume fusing the thread to the cloth. In this manner, the thread 139 becomes the connecting thread between adjacent cut lengths of cloth, and the cut lengths of cloth will then move through a folder. As previously described, the connecting thread functions to pull the leading edge of a cut length of cloth through the folder. The fold is again sewn closed as it emerges from the folder.

The thread used by the sewing machine for sewing the fold closed can also be a nylon or other fusable thread, if desired. If both threads are fusable, a heater, such as radiant heater 150, can be mounted in line with the now folded hems and radiate heat toward the connecting threads and hem threads to melt the threads between adjacent lengths of cloth, thus separating the lengths of cloth from one another. With this arrangement, the mechanical cutting devices previously disclosed can be omitted from the system.

Figure 6:
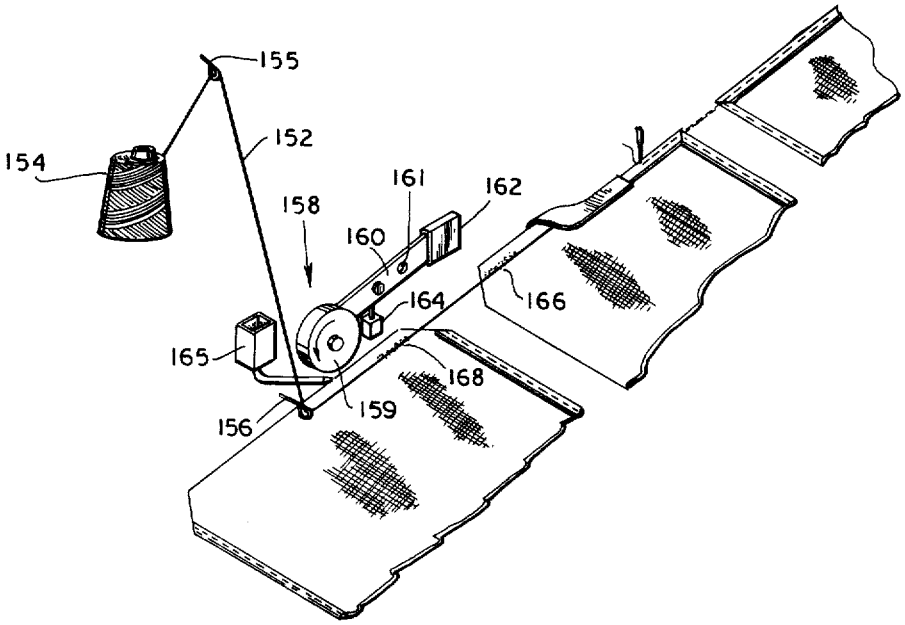
FIG. 6 is a detail illustration of a portion of the process, similar to FIGS. 3 and 5, but showing a third embodiment of the invention.

FIG. 6 illustrates a second alternate embodiment of the connecting thread feature of the invention. A conventional cotton or other type thread 152 is guided from a supply 154 through thread guides 155 and 156 to a position adjacent the path traveled by the cut lengths of cloth, and the thread is paid out onto the surface of the cloth. A spot adhesive apparatus 158 functions to apply adhesives at spaced intervals or at "spots" along the thread and cut length of cloth. The particular spot adhesive apparatus illustrated in FIG. 6 comprises a pressor roll 159 rotatably supported on one end of a balance beam 160 which has its fulcrum at 161, and includes counterweight 162 and solenoid 164. A supply of liquid adhesive 165 is positioned adjacent the path of the cut end portion of the lengths of cloth and presser roll 159. A pair of photoelectric cells (not shown) are positioned vertically with respect to the path of movement of the cut length of cloth and spaced apart along the length of the path, adjacent the spot adhesive apparatus, and the first photoelectric cell detects the presence of the trailing edge of a cut length of cloth and its signal is received by solenoid 164 which oscillates the balance beam in a counterclockwise direction against the influence of counterweight 162 so that presser roll 159 moves downwardly into contact with the thread 152 and the edge portion of the cut length of cloth. The supply of liquid adhesive is contacted by the presser roll and functions to wet the peripheral surface of the presser roll with its adhesive. As the presser roll rotates on the surface of the trailing portion of the moving cut length of cloth, the adhesive applied thereto is rolled into the thread 152 and the cut length of cloth. After a time delay, the solenoid 164 allows counterweight 162 to oscillate the presser roll 159 upwardly away from the supply of liquid adhesive and from the thread and cloth. As the cut length of cloth continues its movement out from under presser roll 159, the spot of adhesive applied to the cut length of cloth will continue to pull the thread 152 from its supply 154 so that the thread continues to pay out behind the cut length of cloth. When the second photoelectric cell (not shown) spaced along the path of travel of the cut lengths of cloth detects the leading end of the subsequent cut length of cloth that is about to pass beneath presser roll 159, its signal is transmitted to solenoid 164 which again causes the presser roll to move downwardly against the influence of counterweight 162 and into contact again with the thread and cloth and apply its adhesive to the thread and cloth. After a short time delay, the solenoid 164 is deactuated and allows counterweight 162 to lift the presser roll 169 upwardly from the thread and cloth. Thus, thread 162 is adhesively secured to the trailing and leading edges of the cut lengths of cloth at the spots indicated at 166 and 168.

As the cut lengths of cloth pass from the spot adhesive apparatus 158 into the subsequent folder and sewing machine, a hem is folded over and sewn closed, as previously descibed. The adhesive applied at spots 166 and 168 and the thread 152 will be folded into the hem. The adhesive can be of any suitable type, but the type preferred is one of the washable adhesives that dissolves in the presence of water so that the adhesive will be removed from the finished product when the finished product is washed for the first time.

FIG. 7 illustrates a third alternate embodiment of the connecting thread feature of the invention. Again, a continuous length of thread 170 is taken from a supply 171 and guided through thread guides 172 and 174 to a position adjacent the path traveled by the cut lengths of cloth, and the thread is paid out onto the surface of the cloth. A spot adhesive apparatus 175 is actuated in response to a photoelectric cell (not shown) located vertically with respect to the path of the cut lengths of cloth adjacent the spot adhesive apparatus 175. The particular spot adhesive apparatus illustrated in this embodiment of the invention includes a balance beam 176 which oscillates about a fulcrum 178 under the influence of solenoid 179. Counterweight 180 is located on one end of the balance beam 176 and an adhesive dispenser 181 is supported on the other end of the balance beam. Counterweight 180 normally maintains its end of the balance beam 176 in a lowered position, thus raising the adhesive dispenser 181 away from the path of travel of the cut lengths of cloth. When the photoelectric cell detects the leading edge of a cut length of cloth moving beneath the spot adhesive apparatus 175, its signal is transmitted to solenoid 179, which pulls the end of the balance beam supporting the adhesive dispenser 181 in a downward direction, so that the adhesive dispenser makes contact with the leading portion of the cut lengths of cloth and the thread 170. The adhesive dispenser 181 is illustrated as being a reciprocatable dispenser which includes a downward depending dispenser tube 182 that reciprocates with respect to its upper housing 184, so that when the lower end of the dispenser tube makes contact with the cloth, it reciprocates up into its housing 184 and functions to dispense and leave a deposit or spot 185 of adhesive on the cloth and thread. After a short time delay, the signal from the photoelectric cell to the solenoid 179 is terminated so that the counterweight 180 tends to oscillate the balance and adhesive dispenser 181 upwardly away from the cloth.

In the embodiment illustrated in FIG. 7, only one photoelectric cell is utilized and only one spot of adhesive is applied to each cut length of cloth. The spot of adhesive 185 is applied to the leading portion of the cut length of cloth. Since the thread 170 will be folded into the hem of the cut length of cloth, the thread will stay aligned with the side edge portion of the cut length of cloth and no difficulty is encountered in maintaining the thread properly aligned in the system.

FIG. 7 also illustrates a double folder 188 which folds over the edge portion of the cut lengths of cloth twice to make a double fold hem. It should be understood that a single, double or multiple fold hemming device can be used, as may be available and desirable in any of the disclosed embodiments of the invention, and the usual difficulty in passing the edge portion of lengths of cloth through a double fold apparatus is at least partially overcome by the connecting thread system herein disclosed.

While the invention has been disclosed as specifically relating to cut lengths of cloth, it is anticipated that other types of material might be treated by the apparatus and method disclosed herein. In addition, while the conventional chain link stitching, nylon and cotton threads have been specifically described herein as the connecting threads, it will be understood that other types of connecting means might be used to temporarily connect the cut lengths of material and the term "connecting thread" is to be construed to include other connecting means. While the hems are disclosed as being sewn closed, the terms such as "sewing" and "sewing through the folds" are intended to include fusing and other steps which can be used to hold the hem closed. While this invention has been described in specific detail with particular reference to preferred embodiments thereof, it will be understood that variations and modifications can be effected within the spirit and scope of the invention as described herein and as defined in the appended claims.

I claim:

1. A method of forming folded hems in lengths of material comprising moving a series of separate lengths of material in sequence along a path with the edges to be hemmed extending along the path, attaching a connecting thread to the lengths of material adjacent at least one of the edges to be hemmed with the thread extending between adjacent ones of the lengths of material and forming the only connection between the adjacent ones of the lengths of material, progressively folding the edge portion of the lengths of material adjacent the connecting thread and sewing through the folds.

2. The method of claim 1 and wherein the step of attaching a connecting thread to the lengths of material comprises extending the thread across angled cuts formed at the corner portions of the lengths of material.

3. A method of forming folded hems in generally rectangular lengths of material comprising moving a series of lengths of material in sequence along a path with the edges to be hemmed extending along the path, continuously paying out a fusable thread onto the lengths of material as the lengths of material move along their path adjacent the edges to be hemmed with the thread extending between adjacent ones of the lengths of material fusing the thread to the material, and progressively folding the edge portions of the lengths of material, and sewing through the folds.

4. The method of claim 3 and further including the step of melting the portions of the threads extending between adjacent lengths of material after the edges have been hemmed.

5. The method of claim 1 and wherein the step of attaching a connecting thread to the lengths of material comprises paying out a heat meltable thread onto the lengths of material as the lengths of material move along their path, and attaching the thread at the trailing and leading end portions of adjacent lengths of material.

6. The method of claim 1 and wherein the step of progressively folding the edge portions of the lengths of material comprises folding the lengths of material about the connecting thread.

7. A method of forming folded hems in lengths of material comprising feeding the free end of a supply of material along its length to a cutting station, cutting across the length of the material with a cut V-shaped at the opposite edges of the material to form angled corners in the cut lengths of material, moving the cut lengths of material in sequence separately along a path with the cut ends extending along the path, continuously attaching a connecting thread to the lengths of material adjacent the cut ends with a thread that extends between adjacent ones of the lengths of material and forms a connection between adjacent ones of cut lengths of material, folding the cut ends of the lengths of material onto the lengths of material, and sewing through the folds.

8. The method of claim 7 and wherein the step of folding the cut ends of the lengths of material comprises moving the cut ends of the lengths of material in sequence and the connecting threads through a folding device.

9. The method of claim 7 and further including the step of folding at least one edge of the supply of material and sewing through the fold as the supply of material is fed along its length to the cutting station.

10. The method of claim 7 and wherein the step of moving the cut lengths of material in sequence along a path with the cut ends extending along the path comprises moving the cut lengths of material in sequence along a U-shaped path, and wherein the step of folding the cut ends of the lengths of material onto the lengths of material comprises folding over one cut end of the lengths of material as the lengths of material move along one leg of the U-shaped path and folding under the other cut end of the lengths of material as the lengths of material move along the other leg of the U-shaped path.

11. The method of claim 7 further including the step of inducing a stream of air approximately parallel to the plane of the lengths of material away from the hemmed edges to urge the connecting thread beyond the sides of the path, and cutting the connecting thread.

12. A method of forming folded hems in the edges of lengths of material comprising separately moving a plurality of the lengths of material in sequence along a path with the edges to be hemmed extending approximately parallel to the direction of movement of the lengths of material along the path, continuously connecting a continuous thread to the lengths of material adjacent the edges to be hemmed as the lengths of material move along the path and extending the continuous thread between adjacent ones of the lengths of material to form a connecting thread between the sequential lengths of material, moving the edges to be hemmed of the lengths of material sequentially through a folding apparatus.

13. The method of claim 12 and wherein the step of moving the edges to be hemmed of the lengths of material sequentially through the folding apparatus includes moving the connecting thread through the folding apparatus.

14. In a method of forming folded hems in lengths of material wherein the lengths of material are moved separately in sequence along a path with their edges to be hemmed extending along the path and the edges to be hemmed are moved through a folding device and folded over and the fold is sewn, the improvement therein comprising attaching a connecting thread to the lengths of material as the sequence of lengths of material move along the path along a line adjacent the edges of the lengths of material which are to be folded and extending the connecting thread between the adjacent separate lengths of material, whereby the portions of the connecting thread extending between adjacent lengths of material connect the adjacent lengths of material in spaced relationship and aid in guiding the edges to be folded through the folding device.

15. Apparatus for forming folded hems in lengths of material comprising means for moving a web of material along its length from a supply toward a cutting station, means for folding over and sewing through at least one side edge portion of the web of material as the web of material is moved along its length toward the cutting station, means for cutting across the length of the web of material with a V-shaped cut at the side edge portions to form angled corners in the cut lengths of material, means for moving the cut lengths of material in sequence separately along a path with the cut ends of the lengths of material extending along the path, means for paying out and connecting a continuous thread to the cut lengths of material whereby the thread extends between adjacent ones of the cut lengths of material adjacent the cut ends of the lengths of material as the cut lengths of material move in sequence along the path, means for folding over the cut ends of the lengths of material onto the lengths of material as the cut lengths of material move in sequence along the path, means for continuously sewing through the folds as the cut lengths of material move in sequence along the path, and means for cutting the continuous thread between adjacent cut lengths of material.

16. A method of forming folded hems in lengths of cloth or the like comprising moving the lengths of cloth separately along a path with the edges to be hemmed extending along the path, progressively paying out a continuous connecting thread onto the separate lengths of cloth adjacent the edges to be hemmed, attaching the connecting thread to the lengths of cloth at a position adjacent the leading end of each length of cloth, pulling each length of cloth with the connecting thread from the preceding length of cloth through a folding device, folding the edge of the length of cloth about the connecting thread, sewing through the folds, and separating the lengths of cloth from one another.

17. Apparatus for forming folded hems in lengths of material comprising conveying means for moving a plurality of lengths of cloth along their lengths in separate spaced relationship along a path of travel with the edges to be hemmed extending along the path of travel, connecting means positioned adjacent said conveying means for extending a connecting thread along the lengths of cloth adjacent the edges to be hemmed and for attaching the connecting thread to the leading end portion of each length of material, folding means positioned along the path of travel behind said connecting means for folding over the edges of the lengths of material to be hemmed, and sewing means positioned along the path of travel behind said folding means for sewing through the folds of the lengths of material.

18. The method of claim 1 and wherein the step of attaching a connecting thread to the lengths of material comprises paying out a thread onto the lengths of material as the lengths of material move along their path, and attaching the thread to the leading portion of each length of material.

* * * * *